US010925126B2

(12) United States Patent
Kim

(10) Patent No.: US 10,925,126 B2
(45) Date of Patent: Feb. 16, 2021

(54) COOKER

(71) Applicant: LG ELECTRONICS INC., Seoul (KR)

(72) Inventor: Honggyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1217 days.

(21) Appl. No.: 14/979,761

(22) Filed: Dec. 28, 2015

(65) Prior Publication Data

US 2016/0183711 A1 Jun. 30, 2016

(30) Foreign Application Priority Data

Dec. 26, 2014 (KR) ..... 10-2014-0191051

(51) Int. Cl.

| | |
|---|---|
| ***F24C 7/08*** | (2006.01) |
| ***H05B 1/02*** | (2006.01) |
| ***H05B 6/64*** | (2006.01) |
| ***H05B 6/06*** | (2006.01) |

(52) U.S. Cl.

CPC ..... *H05B 6/6435* (2013.01); *F24C 7/087* (2013.01); *H05B 1/0258* (2013.01); *H05B 6/062* (2013.01)

(58) Field of Classification Search

CPC ..... A47J 27/62; A47J 36/32; A47J 36/321; F24C 7/087; H05B 1/0258; H05B 1/0261; H05B 1/0263; H05B 1/0266; H05B 1/0269; H05B 6/06; H05B 6/062; H05B 6/065

USPC ..... 99/325–336; 340/426.26, 540, 545.3, 340/870.16

See application file for complete search history.

(56) References Cited

U.S. PATENT DOCUMENTS

| | | | | |
|---|---|---|---|---|
| 4,820,891 | A * | 4/1989 | Tanaka | H03L 5/02 219/626 |
| 6,294,994 | B1 * | 9/2001 | Hoellerich | F24C 7/08 219/490 |
| 2005/0109333 | A1 | 5/2005 | Thomas | |
| 2010/0073174 | A1 * | 3/2010 | Dufour | G08B 17/10 340/628 |

FOREIGN PATENT DOCUMENTS

| | | |
|---|---|---|
| CN | 1395064 | 2/2003 |
| CN | 102893490 | 1/2013 |
| DE | 10130198 | 1/2003 |
| EP | 1276351 | 1/2003 |
| JP | 06-300280 A | 10/1994 |
| JP | 10-300100 A | 11/1998 |
| JP | 2004-293953 | 10/2004 |
| KR | 10-2003-0005948 | 1/2003 |

(Continued)

OTHER PUBLICATIONS

Extended European Search Report issued in European Application No. 15202268.7 dated May 6, 2016, 8 pages.

(Continued)

*Primary Examiner* — Janie M Loeppke

(74) *Attorney, Agent, or Firm* — Fish & Richardson P.C.

(57) ABSTRACT

A circuit for driving a cooker includes a sensing unit configured to sense a movement of a user of a cooker. The circuit further includes a contact unit configured to switch a power circuit to which power is supplied from the outside, and perform a closing operation on the basis of a sensing result from the sensing unit to allow power to be supplied to the cooker.

13 Claims, 6 Drawing Sheets

(56) References Cited

FOREIGN PATENT DOCUMENTS

| | | |
|---|---|---|
| WO | 2007/139521 | 12/2007 |
| WO | 2011/133119 | 10/2011 |

OTHER PUBLICATIONS

Korean Office Action dated Dec. 14, 2015 for Korean Application No. 10-2014-0191051, 16 pages.
Chinese Office Action in Chinese Application No. 201510993914.7, dated Oct. 24, 2017, 16 pages (with English translation).

* cited by examiner

COOKER

CROSS-REFERENCE TO RELATED APPLICATION

Pursuant to 35 U.S.C. § 119(a), this application claims the benefit of earlier filing date and right of priority to Korean Application No. 10-2014-0191051, filed on Dec. 26, 2014, the contents of which is incorporated by reference herein in its entirety.

FIELD

The present disclosure relates to a cooker.

BACKGROUND

A cooker is one of home appliances for cooking food within a container by heating the container using a heat source. Cookers may be classified according hat is sources. For example, cookers include a gas range and a gas oven using a gas, and a microwave oven, an electric oven, and an induction heating cooker using electric power. The microwave oven or the electric oven are cookers cooking food using microwaves, in which a microwave generated by a magnetron to which a high voltage is applied is irradiated to a food item within a cooking chamber through a wave guide to vibrate water molecules contained in the food item to generate heat energy, thus cooling the food item.

Cookers are used in most houses such that a power plug connected to a product is connected to an external alternating current (AC) power source, and in this state, a start switch, or the like, is selectively used, and after the cooker is used, the power plug continues to be put in an electrical outlet.

SUMMARY

According to an innovative aspect of the subject matter described in this application, a circuit for driving a cooker includes a sensing unit configured to sense a movement of a user of a cooker; and a contact unit configured to switch a power circuit to which power is supplied from the outside, and perform a closing operation on the basis of a sensing result from the sensing unit to allow power to be supplied to the cooker.

The cooker may include one or more of the following optional features. The sensing unit includes an infrared sensor configured to infrared-sense a movement of the user; and a signal generating unit configured to generate an operation signal regarding controlling of the closing operation of the contact unit according to the sensing result. When a movement of the user of the cooker is sensed for a predetermined period of time, the signal generating unit generates the operation signal. The contact unit is an a contact which is open at normal times and closed at the time of operation, and performs the closing operation on the basis of the operation signal generated by the sensing unit.

According to another innovative aspect of the subject matter described in this application, a system for driving a cooker includes a driving unit including a sensing unit configured to sense a movement of a user of a cooker and a contact unit configured to switch a power circuit to which power is supplied from the outside and perform a closing operation on the basis of a sensing result from the sensing unit to allow power to be supplied to the cooker; and a control unit configured to be driven by power supplied through the power circuit to control an operation of the contact unit.

The system may include one or more of the following optional features. The sensing unit is positioned on a front portion of the cooker, infrared-senses a movement of the user of the cooker, and generates an operation signal regarding controlling of the closing operation of the contact unit according to the sensing result. When a movement of the user of the cooker is sensed for a predetermined period of time, the sensing unit generates the operation signal. The contact unit performs the closing operation on the basis of the operation signal generated by the sensing unit and maintains the closing operation on the basis of a signal generated by the control unit, and when there is no signal generated by the sensing unit or the control unit, the contact unit is returned. After the control unit is driven by power supplied through the power circuit, the control unit controls the contact unit to maintain the closing operation.

According to an innovative aspect of the subject matter described in this application, a cooker includes a driving unit including a sensing unit configured to sense a movement of a user of a cooker and a contact unit configured to switch a power circuit to which power is supplied from the outside and perform a closing operation on the basis of a sensing result from the sensing unit to receive power; a cooking unit configured to perform a cooking operation of the cooker; and a control is unit configured to be driven by power supplied through the power circuit to control operations of the contact unit and the cooking unit.

The cooker may include one or more of the following optional features. The sensing unit is positioned on a front portion of the cooker, infrared-senses a movement of the user, and generates an operation signal regarding controlling of the closing operation of the contact unit according to the sensing result. When a movement of the user of the cooker is sensed for a predetermined period of time, the sensing unit generates the operation signal. The contact unit performs the closing operation on the basis of the operation signal generated by the sensing unit and maintains the closing operation on the basis of a signal generated by the control unit, and when there is no signal generated by the sensing unit or the control unit, the contact unit is returned. After the control unit is driven by power supplied through the power circuit, the control unit controls the contact unit to maintain the closing operation, and as the driving of the control unit is maintained by maintaining power supplied through the power circuit, the control unit controls an operation of the cooker. While the control unit controls the operation of the cooker, the control unit controls the contact unit to maintain the closing operation.

According to another innovative aspect of the subject matter described in this application, a method for driving a cooker that includes a driving unit including a sensing unit configured to sense a movement of a user of a cooker and a contact unit configured to switch a power circuit to which power is supplied from the outside; a cooking unit configured to perform a cooking operation of the cooker; and a control unit configured to be driven by power supplied through the power circuit to control operations of the contact unit and the cooking unit, the method including the actions of sensing, by the sensing unit, a movement of a user of the cooker; performing, by the contact unit, a closing operation on the basis of the sensing result; driving the cooking unit and the control unit with power supplied through the power circuit; controlling, by the control unit, an operation of the contact unit to maintain the closing operation; and maintaining driving of the cooking unit and the control unit by maintaining power supplied through the power circuit.

The method may include one or more of the following optional features. The sensing of a movement of the user of the cooker includes infrared-sensing a movement of the user of the cooker; generating an operation signal regarding controlling of the closing operation of the contact unit according to the sensing result; and transmitting the operation signal to the contact unit. The action of generating of the operation signal, when a movement of the user of the cooker is sensed for a predetermined period of time, the operation signal is generated. The action of controlling of the operation of the contact unit includes generating a sustain signal regarding controlling maintaining of the closing operation of the contact unit; and transmitting the sustain signal to the contact unit. The action of maintaining of the driving of the cooking unit and the control unit includes controlling, by the control unit, an operation of the cooking unit; and controlling, by the control unit, the contact unit to maintain the closing operation, while controlling the operation of the cooking unit.

It is an object of the subject matter described in this application to provide a circuit for driving a cooker, capable of reducing standby power consumption and increasing user convenience and stability of a cooker, a system for driving a cooker, a cooker, and a method for driving a cooker.

DETAILED DESCRIPTION

Figure 1:
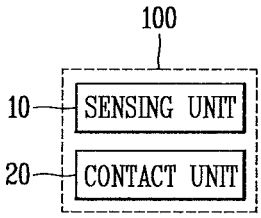
FIGS. 1 and 2 are views of example circuits for driving a cooker.
Figure 2:
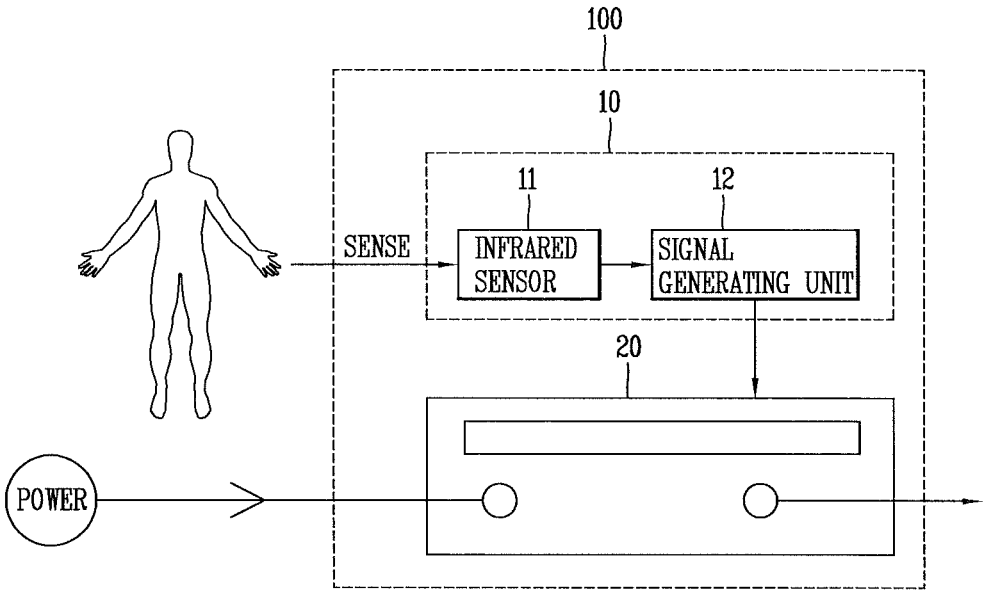

FIGS. 1 and 2 illustrate example circuits for driving a cooker.

As illustrated in FIG. 1, a circuit 100 for driving a cooker (hereinafter, referred to as a "driving circuit") includes a sensing unit 10 sensing a movement of a user who uses a cooker and a contact unit 20 switching a power circuit to which power is supplied from the outside and performing a closing operation on the basis of a sensing result from the sensing unit 10 to supply power to the cooker.

The driving circuit 100 may refer to a circuit for supplying power to drive the cooker.

The driving circuit 100 may be a circuit included in the cooker.

The driving circuit 100 may be a circuit connected to the outside of the cooker and driving the cooker.

The driving circuit 100 may be configured in the form of a module.

In the driving circuit 100, the sensing unit 10 may sense a movement of the user of the cooker, and the contact unit 20 may performing a closing operation on the basis of the sensing result from the sensing unit 10 so that the power circuit, to which power is supplied from the outside, is closed to allow power to be supplied to the cooker.

As illustrated in FIG. 2, the driving circuit 100 may be connected to the power circuit to which power is supplied from the outside, to allow power to be supplied to the cooker.

The sensing unit 10 may be positioned on a front portion of the cooker.

In some implementations, the sensing unit 10 may sense a movement of the user on a front portion of the cooker.

The sensing unit 10 may include an infrared sensor 11 infrared-sensing a movement of the user.

The infrared sensor 11 may be configured to identify movement of the user by sensing infrared light.

The infrared sensor 11 may refer to a passive infrared ray sensor sensing a change in infrared rays according to a movement of a human body and converting the sensed change into an amount of electricity.

The sensing unit 10 may sense a movement of the user on the front portion of the cooker through the infrared sensor 11.

The sensing unit 10 may further include a signal generating unit 12 generating an operation signal regarding controlling of a closing operation of the contact unit 20.

The signal generating unit 12 may be configured to generate the operation signal based on the infrared sensor identifying movement of the user.

In some implementations, the sensing unit 10 may generate the operation signal according to a sensing result from the infrared sensor 11 through the signal generating unit 12.

The signal generating unit 12 may generate the operation signal in a case in which a movement of the user of the cooker is sensed for a predetermined period of time.

The predetermined period of time may be a period of time during which the user is supposed to use the cooker.

For example, the predetermined period of time may be a period of time of 3 seconds or greater.

The sensing unit 10 may sense a movement of the user on the front portion of the cooker for a predetermined period of time through the infrared sensor 11, and in some implementations, in which a movement of the user is sensed for the predetermined period of time, since the user is supposed to use the cooker, the sensing unit 10 may generate the operation signal according to the sensing result for the predetermined period of time through the signal generating unit 12.

The sensing unit 10 may generate the operation signal and transmit the generated operation signal to the contact unit 20.

The contact unit 20 may be configured to disconnect power that is received.

The contact unit 20 may be configured to provide to the cooker, power that is received from the power circuit in response to the operation signal from the sensing unit.

The contact unit 20 may receive the operation signal from the sensing unit 10.

The contact unit 20 may switch the power circuit supply power from the outside to the cooker, so that power may be supplied to the cooker or power supply to the cooker may be cut off.

The contact unit 20 may be an physical contact (a contact or switch) which is open at normal times and which is closed at the time of operation, or the contact unit 20 may comprise a switch that is configured to be open except during operation of the cooker and is configured to close in response to the operation signal.

In some implementations, the contact unit 20 is open at normal times not to supply power to the cooker, and is closed at the time of operation to supply power to the cooker.

Upon receiving the generated operation signal from the sensing unit 10, the contact unit 20 may perform a closing operation on the basis of the operation signal.

Upon receiving the operation signal, which has been generated on the basis of a result of sensing a movement of the user on the front portion of the cooker for a predetermined period of time, from the sensing unit 10, the contact unit 20 may perform a closing operation to supply power to the cooker.

Figure 3:
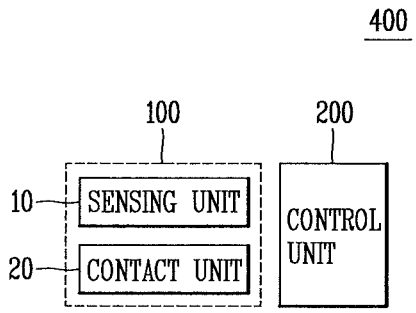
FIGS. 3 and 4 are views of example systems for driving a cooker.
Figure 4:
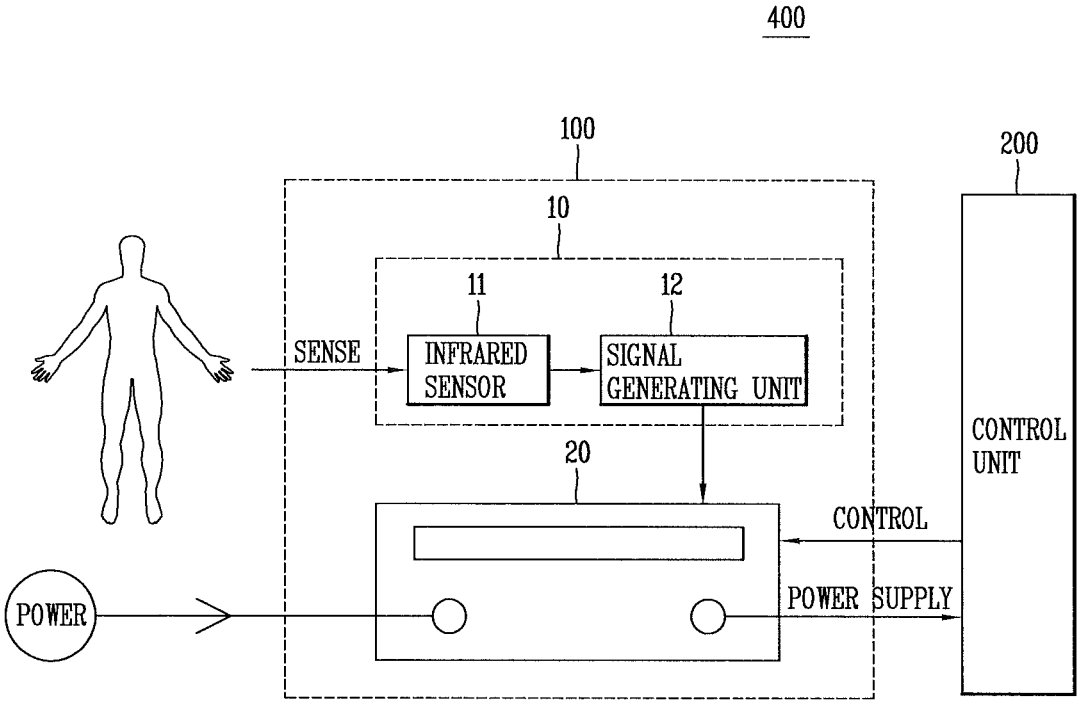

FIGS. 3 and 4 illustrate example systems for driving a cooker.

As illustrated in FIG. 3, a system 400 for driving a cooker (hereinafter, referred to as a "driving system") includes a driving unit 100 including a sensing unit 10 sensing a movement of a user and a contact unit 20 switching a power circuit to which power is supplied from the outside, and performing a closing operation on the basis of a sensing result from the sensing unit 10 to supply power to the cooker, and a control unit 200 driven by power supplied from the power circuit to control an operation of the contact unit 20.

The driving system 400 may refer to a circuit system for driving the cooker.

The driving system 400 may refer to a system including a plurality of circuits included in the cooker.

The driving system 400 may be a system including the driving circuit 100 described above.

In the driving system 400, the driving unit 100 may allow power for driving the cooker to be supplied to the cooker, and the control unit 200 may be driven by power supplied through the driving unit 100 to control an operation of the contact unit 20.

The driving unit 100 may be the driving circuit 100 described above.

The driving unit 100 may be a circuit included in the cooker.

The driving unit 100 may be a circuit connected to the outside of the cooker to enable the cooker to be driven.

The driving unit 100 may be configured in the form of a module.

The control unit 200 may be a circuit included in the cooker.

The control unit 200 may be a micro controller unit (MCU) controlling driving and an operation of the cooker.

In the driving unit 100, the sensing unit 10 may sense a movement of the user of the cooker, and the contact unit 20 may performing a closing operation on the basis of the sensing result from the sensing unit 10 so that the power circuit, to which power is supplied from the outside, is closed to allow power to be supplied to the cooker.

As illustrated in FIG. 4, the driving circuit 100 may be connected to the power circuit to which power is supplied from the outside, to allow power to be supplied to the cooker including the control unit 200.

The sensing unit 10 may be positioned on a front portion of the cooker.

The sensing unit 10 may infrared-sense a movement of the user of the cooker and generate an operation signal regarding controlling of a closing operation of the contact unit 20 according to the sensing result.

The sensing unit 10 may be configured to output the operation signal based on sensed movement of a user.

The sensing unit 10 may include an infrared sensor 11 infrared-sensing a movement of the user.

The infrared sensor 11 may refer to a passive infrared ray sensor sensing a change in infrared rays according to a movement of a human body and converting the sensed change into an amount of electricity.

The sensing unit 10 may sense a movement of the user on the front portion of the cooker through the infrared sensor 11.

The sensing unit 10 may further include a signal generating unit 12 generating an operation signal regarding controlling of a closing operation of the contact unit 20.

When a movement of the user of the cooker is sensed for a predetermined period of time, the sensing unit 10 may generate the operation signal though the signal generating unit 12.

The predetermined period of time may be a period of time during which the user is supposed to use the cooker.

For example, the predetermined period of time may be a period of time of 3 seconds or greater.

In some implementations, the sensing unit 10 senses a movement of the user on the front portion of the cooker for a predetermined period of time through the infrared sensor 11, and in some implementations, in which a movement of the user is sensed for the predetermined period of time, since the user is supposed to use the cooker, the sensing unit 10 may generate the operation signal according to the sensing result for the predetermined period of time through the signal generating unit 12.

The sensing unit 10 may generate the operation signal and transmit the generated operation signal to the contact unit 20.

The contact unit 20 may receive the operation signal from the sensing unit 10.

The contact unit 20 may switch the power circuit supplying power from the outside to the cooker, so that power may be supplied to the cooker or power supply to the cooker may be cut off.

The contact unit 20 may supply power to the cooker to enable the control unit 200 to be driven.

The contact unit 20 may be an physical contact (a contact or switch) which is open at normal times and which is closed at the time of operation.

In some implementations, the contact unit 20 is open at normal times not to supply power to the cooker, and is closed at the time of operation to supply power to the cooker.

Upon receiving the generated operation signal from the sensing unit 10, the contact unit 20 may perform a closing operation on the basis of the operation signal and may maintain the closing operation on the basis of a signal generated by the control unit 200.

In some implementations, the contact unit 10 may receive the operation signal, which has been generated on the basis of a result of sensing a movement of the user on the front portion of the cooker for a predetermined period of time, from the sensing unit 10, perform a closing operation on the basis of the operation signal to supply power to the cooker, and maintain the closing operation under the control of the control unit 200 which is driven upon receiving power.

The contact unit 20 may maintain the closing operation on the basis of the signal generated by the control unit 200 to maintain power supply to the cooker.

The contact unit 20 may be returned to an open state when there is no signal generated by the sensing unit 10 or the control unit 200.

In some implementations, power supply to the cooker is not required so a signal is not generated by the sensing unit 10 or the control unit 200, the contact unit 20 may be returned from the closing operation to a previous state (e.g., an open state) so that power may not be supplied.

The control unit 200 may be driven by power supplied through the power circuit. The control unit 200 may be configured to, based on the control unit 200 controlling the operation of the cooker, maintain the contact unit 20 in a closed position.

After the control unit 200 is driven by power supplied through the power circuit, the control unit 200 may generate a sustain signal for controlling maintaining the closing operation of the contact unit 20.

In some implementations, after the control unit 200 is driven by power supplied through the power circuit, the control unit 200 generates the sustain signal to maintain power supply through the power circuit to thus control the contact unit 20.

The control unit 200 controls the contact unit 20 to maintain the closing operation, whereby power supplied through the power circuit may be maintained to maintain the driving.

After the power supplied through the power circuit is maintained to maintain the driving, the control unit 200 may control an operation of the cooker.

In some implementations, since the control unit 200 is driven upon receiving power through the power circuit, the control unit 200 may control driving and operation of the cooker.

The control unit 200 may control an operation of the cooker such that a cooking function of the cooker is executed.

For example, the control unit may control an operation of the cooker to perform a cooking function corresponding to a user input.

While controlling the operation of the cooker, the control unit 200 may control the contact unit 20 to maintain the closing operation of the contact unit 20.

In some implementations, while the cooking function of the cooker is being performed, the control unit 200 may control the contact unit 20 to maintain the closing operation of the contact unit 20 such that power supply to the cooker is maintained.

Figure 5:
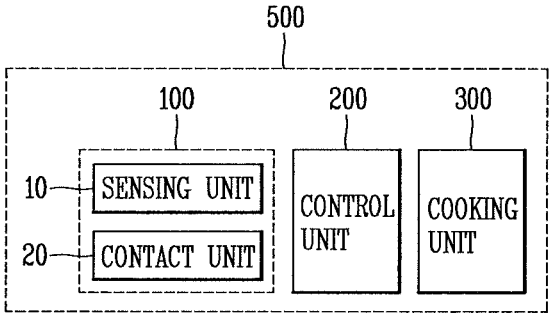
FIGS. 5 and 6 are views of example cookers.
Figure 6:
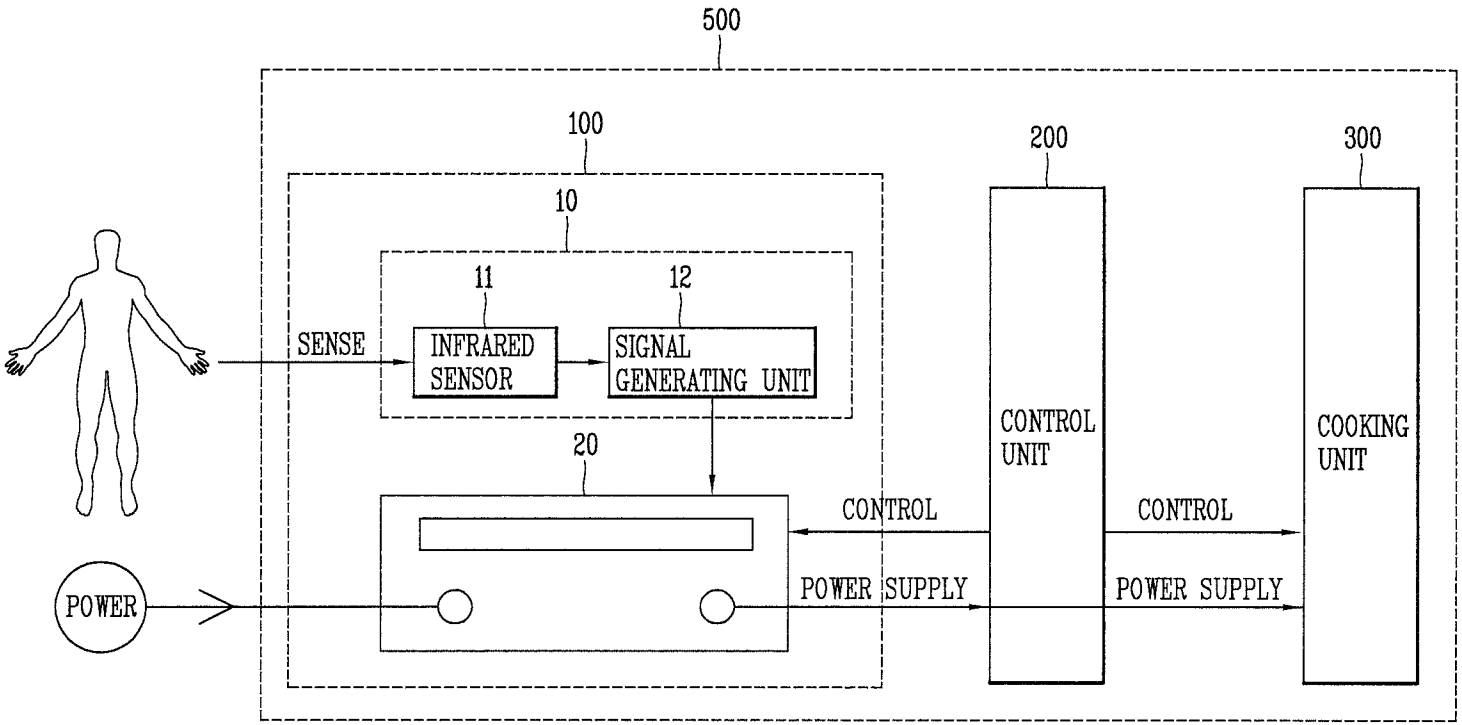
Figure 7:
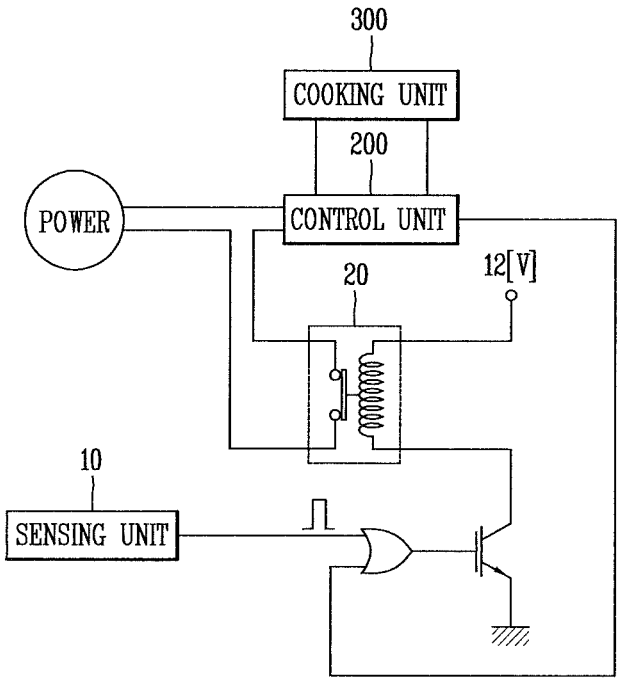
FIG. 7 is a view of an example circuit of a cooker.

FIGS. 5 and 6 illustrate of example cookers. FIG. 7 illustrates an example circuit of a cooker.

As illustrated in FIG. 5, the cooker 500 includes a driving unit 100 including a sensing unit 10 sensing a movement of a user who uses a cooker and a contact unit 20 switching a power circuit to which power is supplied from the outside and performing a closing operation on the basis of a sensing result from the sensing unit 10 to receive power, a cooking unit 300 performing a cooking operation of the cooker 500, and a control unit 200 driven by power supplied through the power circuit to control operations of the contact unit 20 and the cooking unit 300.

The cooker 500 may refer to a device for cooking food using an electric energy, such as a microwave oven, an oven, or an induction heating (IH) cooker.

The cooker 500 may include a plurality of circuits to perform a cooking function.

The cooker 500 may include the driving circuit 100 or the driving system 400 is described above.

In the cooker 500, the driving unit 100 receives power for driving the cooker 500, the cooking unit 300 is driven by power received through the driving unit 100 to perform a cooking operation such that a cooking function of the cooker 500 may be performed, and the control unit 200 may be driven by power received through the driving unit 100 to control operations of the contact unit 20 and the cooking unit 300.

The driving unit 100 may be the driving circuit 100 described above.

The control unit 200 may be a micro controller unit (MCU) controlling driving and an operation of the cooker 500.

The configuration including the driving unit 100 and the control unit 200 may be the driving system 400 described above.

The cooking unit 300 may be driven by the driving system 400 to perform a cooking operation of the cooker 500.

In some implementations, the cooker 500 includes the driving system 400 performing driving and the cooking unit 300 performing cooking, and the cooking unit 300 is driven through the driving system 400 to perform cooking.

In the driving unit 100, the sensing unit 10 may sense a movement of the user of the cooker 500, and the contact unit 20 may performing a closing operation on the basis of the sensing result from the sensing unit 10 so that the power circuit, to which power is supplied from the outside, is closed to receive power.

As illustrated in FIG. 6, the driving circuit 100 may be connected to the power circuit to which power is supplied from the outside, to allow power to be supplied to the cooker including the control unit 200.

The sensing unit 10 may be positioned on a front portion of the cooker.

The sensing unit 10 may infrared-sense a movement of the user of the cooker and generate an operation signal regarding controlling of a closing operation of the contact unit 20 according to the sensing result.

The sensing unit 10 may include an infrared sensor 11 infrared-sensing a movement of the user.

The infrared sensor 11 may refer to a passive infrared ray sensor sensing a change in infrared rays according to a movement of a human body and converting the sensed change into an amount of electricity.

The sensing unit 10 may sense a movement of the user on the front portion of the cooker through the infrared sensor 11.

The sensing unit 10 may further include a signal generating unit 12 generating an operation signal regarding controlling of a closing operation of the contact unit 20.

When a movement of the user of the cooker 500 is sensed for a predetermined period of time, the sensing unit 10 may generate the operation signal though the signal generating unit 12.

The predetermined period of time may be a period of time during which the user is supposed to use the cooker.

For example, the predetermined period of time may be a period of time of 3 seconds or greater.

In some implementations, the sensing unit 10 senses a movement of the user on the front portion of the cooker for a predetermined period of time through the infrared sensor 11, and in some implementations, in which a movement of the user is sensed for the predetermined period of time, since the user is supposed to use the cooker, the sensing unit 10 may generate the operation signal according to the sensing result for the predetermined period of time through the signal generating unit 12.

The sensing unit 10 may generate the operation signal and transmit the generated operation signal to the contact unit 20.

The contact unit 20 may receive the operation signal from the sensing unit 10.

The contact unit 20 may switch the power circuit supplying power from the outside to the cooker 500, so that power may be supplied or cut off.

The contact unit 20 may allow power to be supplied to enable the cooking unit 300 and the control unit 200 to be driven.

The contact unit 20 may be an physical contact (a contact or switch) which is open at normal times and which is closed at the time of operation.

In some implementations, the contact unit 200 is open at normal times to prevent power from being supplied, and is closed at the time of operation to allow power to be supplied.

The contact unit 20 may receive the generated operation signal from the sensing unit 10, perform a closing operation on the basis of the operation signal, and maintain the closing operation on the basis of a signal generated by the control unit 200.

In some implementations, the contact unit 10 may receive the operation signal, which has been generated on the basis of a result of sensing a movement of the user on the front portion of the cooker 500 for a predetermined period of time, from the sensing unit 10 and perform a closing operation to allow power to be supplied, and when the control unit 200 is driven upon receiving power, the contact unit 10 may maintain the closing operation under the control of the control unit 200.

The contact unit 20 may maintain the closing operation on the basis of a signal generated by the control unit 200, such that power supply to the cooking unit 300 and to the control unit 200 is maintained.

The contact unit 20 may be returned to an open state when there is no signal generated by the sensing unit 10 or the control unit 200.

In some implementations, power supply is not required so a signal is not generated by the sensing unit 10 or the control unit 200, the contact unit 20 may be returned from the closing operation to the open state so that power may not be supplied.

The cooking unit 300 may be driven by power supplied through the power circuit.

After the cooking unit is driven by power supplied through the power circuit, an operation of the cooking unit 300 may be controlled by the control unit 200.

The cooking unit 300 may perform a cooking operation on food as a cooking target.

The cooking unit 300 may be controlled by the control unit to perform a cooking function to heat food.

For example, when the cooker 500 is an induction heating (IH) cooker, the control unit 200 may control the cooking unit 300 to heat a cooking container positioned at an upper portion of the cooker 500 to 100° C.

The control unit 200 may be driven by power supplied through the power circuit.

After the control unit 200 is driven by power supplied through the power circuit, the control unit 200 may generate a sustain signal for controlling maintaining the closing operation of the contact unit 20.

In some implementations, after the control unit 200 is driven by power supplied through the power circuit, the control unit 200 generates the sustain signal to maintain power supply through the power circuit to thus control the contact unit 20.

After the control unit 200 is driven by power supplied through the power circuit, the control unit 200 may control the contact unit 20 to maintain the closing operation, whereby power supplied through the power circuit may be maintained to maintain the driving.

After the power supplied through the power circuit is maintained to maintain the driving, the control unit 200 may control an operation of the cooking unit 300.

In some implementations, since the control unit 200 is driven upon receiving power through the power circuit, the control unit 200 may control driving and operation of the cooker.

The control unit 200 may control an operation of the cooker such that a cooking function of the cooker is executed.

For example, the control unit may control an operation of the cooker to perform a cooking function corresponding to a user input.

While controlling the operation of the cooker, the control unit 200 may control the contact unit 20 to maintain the closing operation of the contact unit 20.

In some implementations, while the cooking function of the cooker is being performed, the control unit 200 may control the contact unit 20 to maintain the closing operation of the contact unit 20 such that power supply to the cooker is maintained.

A circuit configuration of the cooker 500 described above may have a form as illustrated in FIG. 7.

As illustrated in FIG. 7, in the cooker 500, the contact unit 20 of the driving unit may perform a closing operation on the basis of signals generated by the sensing unit 10 of the driving unit 100 and the control unit 200.

The sensing unit 10, the control unit 200, and the contact unit 20 may be configured as an OR gate in which an output is performed when there are one or more inputs.

In some implementations, the sensing unit 10 and the control unit 200 are to connected to an input of the OR gate, and an output of the OR gate is connected to the contact unit 20, and accordingly, when the sensing unit 10 or the control unit 200 generates a signal, the contact unit 20 may perform a closing operation.

As for a process of driving the cooker 500, when the sensing unit 10 senses a movement of the user on a front portion of the cooker 500, the sensing unit 10 is generates the operation signal, and when the operation signal is transmitted to the contact unit 20, the contact unit 20 performs a closing operation such that the power circuit to which power is supplied from the outside is closed. Since the power circuit is closed, power is supplied to the cooking unit 300 and the control unit 200, and thus, the control unit 200 may be driven.

After the control unit 200 is driven, the control unit 200 generates the sustain signal to maintain the closing operation of the contact unit 20 in order to continuously receive power, and when the sustain signal is transmitted to the contact unit 20, the contact unit 20 maintains the closing operation, and thus, power supply to the control unit 200 is maintained, whereby driving of the control unit 200 may be maintained.

After driving of the control unit 200 is maintained, the control unit 200 controls an operation of the cooking unit 300 to perform a cooking function of the cooker 500, and in order to continuously receive power while the cooking unit 300 is being operated, the control unit 200 may control the contact unit 200 to maintain the closing operation.

When a signal is not generated by the sensing unit 10 and the control unit 200, it is a situation in which driving of the cooker 500 is not required. Thus, the contact unit 20 is returned from the closing operation and the power circuit is open such that power supply to the cooker 500 may be cut off.

Through the driving of the process described above, when a cooking function is not performed (e.g., when power supply is not required), the power circuit is opened and power is not supplied, and thus, consumption of standby power of the cooker 500 may be reduced and convenience of the user of the cooker 500 and stability may be increased.

FIGS. 8-11 illustrate example methods for driving a cooker.

A method for driving a cooker (hereinafter, referred to as a "driving method") is a method for driving the cooker 500 including the sensing unit 10 sensing a movement of a user of the cooker 500, the cooking unit 300 performing a cooking operation of the cooker 500, and the control unit 200 driven by power supplied through the power circuit to control operations of the contact unit 20 and the cooking unit 300.

The driving method may be the method for driving the cooker 500 described above.

Figure 8:
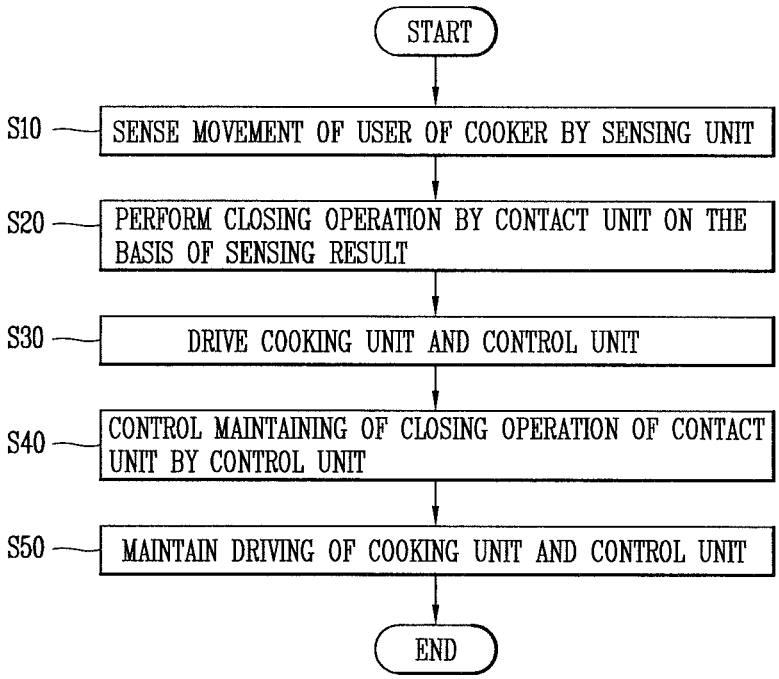
FIGS. 8-11 are flow charts of example methods for driving a cooker.

As illustrated in FIG. 8, the driving method includes: step (S10) in which the sensing unit 10 senses a movement of a user of the cooker 500, step (S20) in which the contact unit 20 performs a closing operation on the basis of the sensing result, step (S30) in which the cooking unit 300 and the control unit 200 are driven with power supplied through the power circuit, step (S40) in which the control unit 200 controls an operation of the contact unit 20 to maintain the closing operation, and step (S50) in which driving of the cooking unit 300 and the control unit 200 is maintained by maintaining power supplied through the power circuit.

Step (S10) of sensing a movement of a user of the cooker 500 may be performed by the sensing unit 10.

In step (S10) of sensing a movement of the user of the cooker 500, a movement of the user on the front portion of the cooker 500 may be sensed through the sensing unit 10 positioned on the front portion of the cooker 500.

Figure 9:
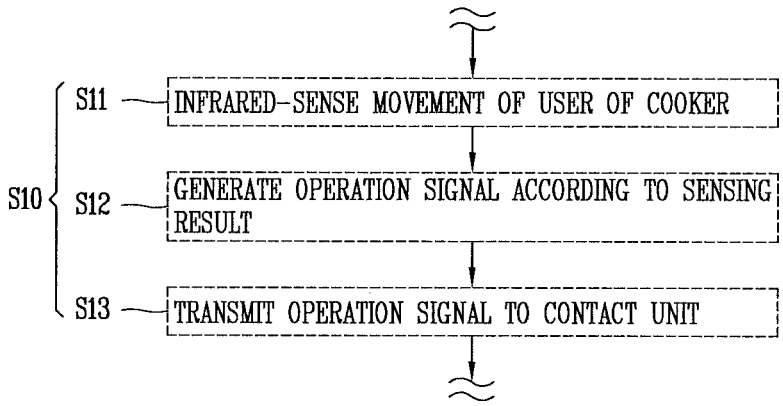

As illustrated in FIG. 9, step (S10) of sensing a movement of the user of the cooker 500 may include step (S11) of infrared-sensing a movement of the user of the cooker 500, step (S12) of generating an operation signal regarding controlling of a closing operation of the contact unit 20 according to the sensing result, and step (S13) of transmitting the operation signal to the contact unit 20.

In step (S11) of infrared-sensing a movement of the user of the cooker 500, the sensing unit 10 may infrared-sense a movement of the user on the front portion of the cooker 500.

In step (S12) of generating an operation signal, the sensing unit 10 may generate an operation signal regarding controlling of a closing operation of the contact unit 20 according to the sensing result.

In step (S12), when a movement of the user of the cooker 500 is sensed for a predetermined period of time, the sensing unit 10 may generate the operation signal.

The predetermined period of time may be a period of time during which the user is supposed to use the cooker 500.

For example, the predetermined period of time may be a period of time of three seconds or more.

In step (S13) of transmitting the operation signal to the contact unit 20, the sensing unit 10 may transmit the operation signal to the contact unit 20.

Step (S20) of performing a closing operation on the basis of the sensing result may be performed through the contact unit 20.

In step (S20) of performing a closing operation on the basis of the sensing result, the contact unit 20 performs a closing operation on the basis of a signal transmitted from the sensing unit 10 to close the power circuit which receives power from the outside.

In step (S20) of performing a closing operation on the basis of the sensing result, the contact unit 20 switches the power circuit which receives power from the outside to supply power to the cooking unit 300 and the control unit 200 or to cut off power supply thereto.

Step (S30) of driving the cooking unit 300 and the control unit 200 may be performed through the cooking unit 300 and the control unit 200 upon receiving power as the contact unit 20 performs a closing operation.

In step (S30) of driving the cooking unit 300 and the control unit 200, the cooking unit 300 and the control unit 200 may be provided with power so as to be is driven.

Step (S40) of controlling an operation of the contact unit 20 may be performed through the control unit 200.

Figure 10:
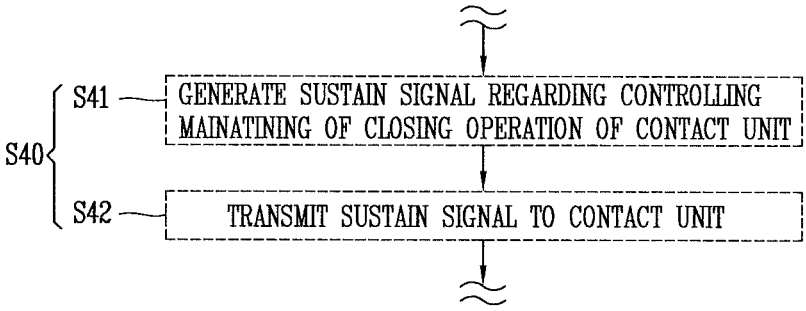
Figure 11:
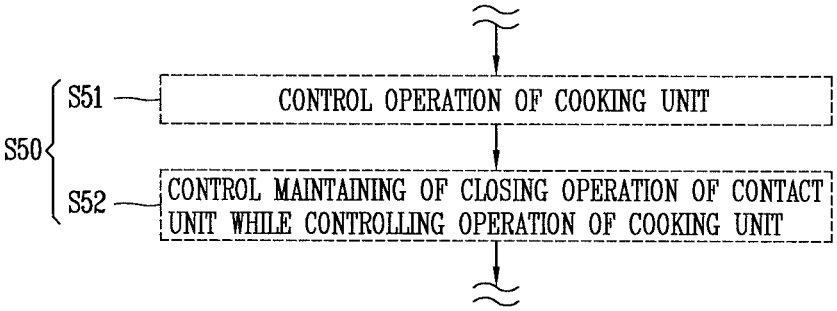

As illustrated in FIG. 10, step (S40) of controlling an operation of the contact unit 20 may include step (S41) of generating a sustain signal regarding controlling of maintaining a closing operation of the contact unit 20 and step (S42) of transmitting the sustain signal to the contact unit 20.

In step (S41) of generating a sustain signal, after the control unit 200 is driven by power supplied through the power circuit, the control unit 200 may generate a sustain signal regarding controlling of maintaining the closing operation of the contact unit 20.

In step (S42) of transmitting the sustain signal to the contact unit 20, the control unit 20 may transmit the sustain signal to the contact unit 20.

In some implementations, in step (S40) of controlling the operation of the contact unit 20, after the controller 200 is driven with power supplied through the power circuit, the control unit 200 may generate the sustain signal to maintain power supply through the power circuit to thus control the contact unit 20.

Step (S50) of maintaining driving of the cooking unit 300 and the control unit 200 may be performed through the control unit 200 maintained in driving as power supplied through the power circuit is maintained.

In step (S50) of maintaining driving of the cooking unit 300 and the control unit 200, the contact unit 20 maintains the closing operation on the basis of a signal generated by the control unit 200 such that power supply to the cooking unit 300 and the control unit 200 is maintained.

Step (S50) of maintaining driving of the cooking unit 300 and the control unit 200 may include step (S51) in which the control unit 200 controls an operation of the cooking unit 300 and step (S52) in which, while the control unit 200 controls the operation of the cooking unit 300, the control unit 200 controls the contact unit 20 to maintain the closing operation.

In step (S51) of controlling an operation of the cooking unit 300, in a state in which driving of the control unit 200 is maintained by maintaining power supplied through the power circuit, an operation of the cooking unit 300 may be controlled.

In step (S51) of controlling an operation of the cooking unit 300, the control unit 200 may control an operation of the cooking unit 300 such that a cooking function of the cooker 500 is performed.

Step (S52) of controlling the contact unit 20 to maintain the closing operation, while the control unit 200 controls an operation of the cooking unit 300, the contact unit 20 may be controlled to maintain the closing operation.

In some implementations, in step (S50) of maintaining driving of the cooking unit 300 and the control unit 200, the control unit 200 is driven upon receiving power through the power circuit to control driving and an operation of the cooker 500.

In some implementations, the circuit for driving a cooker, the system for driving a cooker, the cooker, and the method for driving a cooker disclosed in the present disclosure may be applied to and implemented in power circuits and driving circuits of home appliances and power circuits and driving circuits of industrial electric equipment.

In some implementations, the circuit for driving a cooker, the system for driving a cooker, the cooker, and the method for driving a cooker disclosed in the present disclosure may be applied to and implemented in power supply devices, power supply systems, driving devices, and driving system of home appliances and industrial electric equipment.

In some implementations, the circuit for driving a cooker, the system for driving a cooker, the cooker, and the method for driving a cooker disclosed in the present disclosure may be applied to and implemented power supply methods and driving methods of home appliances and industrial electric equipment.

In some implementations, the circuit for driving a cooker, the system for driving a cooker, the cooker, and the method for driving a cooker disclosed in the present disclosure may be applied to and implemented in induction heating cookers using electric energy.

According to the circuit for driving a cooker, the system for driving a cooker, the cooker, and the method for driving a cooker disclosed in the present disclosure, since power is supplied according to a result of sensing a movement of a user, consumption of standby power may be reduced.

According to the circuit for driving a cooker, the system for driving a cooker, the cooker, and the method for driving a cooker disclosed in the present disclosure, since power is supplied according to a result of sensing a movement of a user, insulation of cooker and electric leakage may be reduced.

According to the circuit for driving a cooker, the system for driving a cooker, the cooker, and the method for driving a cooker disclosed in the present disclosure, since insulation of cooker and electric leakage are reduced, usage stability of a cooker may be increased.

According to the circuit for driving a cooker, the system for driving a cooker, the cooker, and the method for driving a cooker disclosed in the present disclosure, since power is supplied according to a result of sensing a movement of the user, power supply and driving of a cooker may be automatically performed.

According to the circuit for driving a cooker, the system for driving a cooker, the cooker, and the method for driving a cooker disclosed in the present disclosure, since power supply and driving of a cooker are automatically performed, usage convenience of a cooker may be increased.

What is claimed is:

1. A circuit for driving a cooker, the cooker comprising:
- a sensing unit configured to sense a movement of a user of a cooker;
- a contact unit configured to switch a power circuit to which power is supplied from an outside of the cooker, and perform a closing operation based on a sensing result from the sensing unit to allow power to be supplied to the cooker;
- a control unit configured to be driven by power supplied through the power circuit and to control operation of the contact unit; and
- an OR gate comprising:
  - a first input node that is connected to the sensing unit and that is configured to receive an operation signal from the sensing unit,
  - a second input node that is connected to the control unit and that is configured to receive a control signal from the control unit, and
  - an output node that is connected to the contact unit and that is configured to, in response to at least one of the operation signal from the sensing unit or the control signal from the control unit, output an output signal to the contact unit to thereby perform the closing operation of the contact unit,
- wherein the contact unit is further configured to:
  - maintain an open state at normal times in which no power is supplied to the control unit,
  - perform the closing operation at operation times based on the operation signal generated by the sensing unit,
  - maintain the closing operation based on the control signal generated by the control unit, and
  - based on a lack of the operation signal or the control signal, return from the closing operation to the open state to cut off the power supplied to the control unit, and
- wherein the control unit is configured to:
  - after being driven by the power supplied through the power circuit, generate the control signal to control the contact unit to maintain the closing operation, and
  - based on the power supplied through the power circuit being maintained, control operation of the cooker.

2. The circuit of claim 1, wherein the sensing unit comprises:
- an infrared sensor configured to infrared-sense a movement of the user; and
- a signal generating unit configured to generate the operation signal to control the closing operation of the contact unit according to the sensing result.

3. The circuit of claim 2, wherein when a movement of the user of the cooker is sensed for a predetermined period of time, the signal generating unit generates the operation signal.

4. The circuit of claim 1, wherein the power circuit is configured to be open to block supply of power to the control unit based on the contact unit returning to the open state.

5. The circuit of claim 1, wherein the contact unit is configured to, based on the lack of the operation signal and the control signal, return from the closing operation to the open state to cut off the power supplied to the control unit.

6. The circuit of claim 1, wherein the contact unit comprises a switch configured to make physical contact between terminals in the operation times and to open the physical contact in the normal times.

7. A system for driving a cooker, the system comprising:
- a driving unit including:
  - a sensing unit positioned on a front portion of the cooker and configured to sense a movement of a user of the cooker by infrared light, the sensing unit being configured to generate an operation signal based on the movement of the user being sensed for a predetermined period of time, and
  - a contact unit configured to switch a power circuit to which power is supplied from the outside and perform a closing operation based on the operation signal generated by the sensing unit to allow power to be supplied to the cooker;
- a control unit configured to be driven by power supplied through the power circuit to control operation of the contact unit; and
- an OR gate comprising:
  - a first input node that is connected to the sensing unit and that is configured to receive an operation signal from the sensing unit, a second input node that is connected to the control unit and that is configured to receive a control signal from the control unit, and an output node that is connected to the contact unit and that is configured to, in response to at least one of the operation signal from the sensing unit or the control signal from the control unit, output an output signal to the contact unit to thereby perform the closing operation of the contact unit, wherein the contact unit is configured to:

maintain an open state at normal times in which no power is supplied to the control unit, perform the closing operation at operation times based on the operation signal generated by the sensing unit and maintain the closing operation based on the control signal generated by the control unit, based on no operation signal from the sensing unit and no control signal from the control unit, return from the closing operation to the open state to cut off the power supplied to the control unit, and wherein the control unit is configured to:

after being driven by the power supplied through the power circuit, generate the control signal to control the contact unit to maintain the closing operation, and based on the power supplied through the power circuit being maintained, control operation of the cooker.

8. A cooker comprising:

a driving unit including a sensing unit configured to sense a movement of a user of a cooker and a contact unit configured to switch a power circuit to which power is supplied from the outside and perform a closing operation based on a sensing result from the sensing unit to receive power;

a cooking unit configured to perform a cooking operation of the cooker;

a control unit configured to be driven by power supplied through the power circuit to control operations of the contact unit and the cooking unit; and an OR gate comprising:

a first input node that is connected to the sensing unit and that is configured to receive an operation signal from the sensing unit, a second input node that is connected to the control unit and that is configured to receive a control signal from the control unit, and an output node that is connected to the contact unit and that is configured to, in response to at least one of the operation signal from the sensing unit or the control signal from the control unit, output an output signal to the contact unit to thereby perform the closing operation of the contact unit, wherein the contact unit is configured to:

maintain an open state at normal times in which no power is supplied to the control unit, perform the closing operation at operation times based on the operation signal generated by the sensing unit and maintain the closing operation based on the control signal generated by the control unit, and based on a lack of the operation signal or the control signal, return from the closing operation to the open state to cut off the power supplied to the control unit, and wherein the control unit is configured to:

after being driven by the power supplied through the power circuit, generate the control signal to control the contact unit to maintain the closing operation, based on the power supplied through the power circuit being maintained, control the cooking operation of the cooker, and control the contact unit to maintain the closing operation while controlling the cooking operation of the cooker.

9. The cooker of claim 8, wherein the sensing unit is positioned on a front portion of the cooker, infrared-senses a movement of the user, and generates the operation signal to control the closing operation of the contact unit according to the sensing result.

10. The cooker of claim 9, wherein when a movement of the user of the cooker is sensed for a predetermined period of time, the sensing unit generates the operation signal.

11. A method for driving a cooker including: a driving unit including a sensing unit configured to sense a movement of a user of a cooker and a contact unit configured to switch a power circuit to which power is supplied from the outside; a cooking unit configured to perform a cooking operation of the cooker; a control unit configured to be driven by power supplied through the power circuit to control operations of the contact unit and the cooking unit; and an OR gate including a first input node connected to the sensing unit, a second input node connected to the control unit, and an output node connected to the contact unit, the method comprising:

maintaining the contact unit in an open state in normal times in which no power is supplied to the control unit;

sensing, by the sensing unit, a movement of a user of the cooker;

performing, by the contact unit, a closing operation at operation times based on a sensing result from the sensing unit;

driving the cooking unit and the control unit with power supplied through the power circuit;

controlling, by the control unit, the contact unit to maintain the closing operation; and maintaining driving of the cooking unit and the control unit by maintaining power supplied through the power circuit, wherein performing the closing operation comprises performing the closing operation based on an operation signal generated by the sensing unit and maintaining the closing operation based on a control signal generated by the control unit, wherein the method further comprises, based on a lack of the operation signal or the control signal, returning the contact unit from the closing operation to the open state to cut off the power supplied to the control unit, wherein controlling the contact unit comprises:

receiving at least one of the operation signal from the sensing unit through the first input node of the OR gate or the control signal from the control unit through the second input node of the OR gate, in response to receiving at least one of the operation signal from the sensing unit or the control signal from the control unit, outputting an output signal through the output node of the OR gate to the contact unit to thereby perform the closing operation of the contact unit, and providing the control signal to control the contact unit to maintain the closing operation while the controller controls the cooking operation of the cooker, and wherein sensing the movement of the user comprises:

sensing the movement of the user of the cooker by infrared light, based on the movement of the user being sensed for a predetermined time, generating the operation signal to control the closing operation of the contact unit, and transmitting the operation signal to the contact unit.

12. The method of claim 11, wherein controlling the contact unit comprises:

generating the control signal corresponding to a sustain signal to maintain the closing operation of the contact unit; and transmitting the sustain signal to the contact unit.

13. The method of claim 11, wherein the maintaining of the driving of the cooking unit and the control unit comprises:

controlling, by the control unit, an operation of the cooking unit; and controlling, by the control unit, the contact unit to maintain the closing operation, while controlling the operation of the cooking unit.

* * * * *